United States Patent [19]

Andersson

[11] Patent Number: 4,635,715

[45] Date of Patent: Jan. 13, 1987

[54] GASKET ARRANGEMENT FOR A PLATE HEAT EXCHANGER

[75] Inventor: Jarl A. Andersson, Lund, Sweden

[73] Assignee: Alfa-Laval Thermal AB, Lund, Sweden

[21] Appl. No.: 709,034

[22] PCT Filed: Jun. 7, 1984

[86] PCT No.: PCT/SE84/00215

§ 371 Date: Jan. 24, 1985

§ 102(e) Date: Jan. 24, 1985

[87] PCT Pub. No.: WO85/00052

PCT Pub. Date: Jan. 3, 1985

[30] Foreign Application Priority Data

Jun. 16, 1983 [SE] Sweden ..... 8303449

[51] Int. Cl.[4] ..... F28F 3/10

[52] U.S. Cl. ..... 165/167; 165/166; 277/181; 277/189; 403/405.1

[58] Field of Search ..... 277/189, 181, 184, 182, 277/183, 189.5; 165/166, 167; 24/67.9; 403/406.1, 405.1; 49/485, 488; 220/405

[56] References Cited

U.S. PATENT DOCUMENTS

| | | | |
|---|---|---|---|
| 1,648,408 | 11/1927 | Kumagai | 24/67.9 |
| 2,550,339 | 4/1951 | Ehrman | 165/167 |
| 2,938,252 | 5/1960 | Scheemaeker | 24/67.9 |
| 3,195,625 | 7/1965 | Thomson | 165/166 |
| 4,377,204 | 3/1983 | Johansson | 165/166 |
| 4,432,415 | 2/1984 | Wright | 165/167 |

FOREIGN PATENT DOCUMENTS

| | | | |
|---|---|---|---|
| 695400 | 10/1964 | Canada | 220/405 |
| 48559 | 3/1982 | European Pat. Off. . | |
| 56-64294 | 6/1981 | Japan . | |
| 493490 | 10/1938 | United Kingdom . | |
| 2069680 | 8/1981 | United Kingdom | 165/166 |

*Primary Examiner*—Allan N. Shoap

*Attorney, Agent, or Firm*—Cyrus S. Hapgood

[57] ABSTRACT

This invention relates to a gasket for a plate heat exchanger which gasket has several projections for securing the gasket to a heat exchanger plate. Said projections protrude towards an edge of the plate along which the gasket extends. According to the invention the gasket projections (2; 10, 11; 14; 20) cooperate with holding parts (2A, 3, 4; 12, 13; 15; 21), each comprising at least one projection (3, 4; 13; 16*a, c*) that is directed to the gasket (1) and is positioned at a distance from the gasket projection (2; 10, 11; 14; 20) seen in the longitudinal direction of the gasket.

8 Claims, 8 Drawing Figures

GASKET ARRANGEMENT FOR A PLATE HEAT EXCHANGER

This invention relates to a gasket arrangement comprising a gasket which is intended to be applied into a groove made along an edge of a heat exchanger plate and which on its side directed to the mentioned edge is provided with projections arranged at a distance from each other—seen in the longitudinal direction of the gasket—which projections are made in one piece with the gasket and arranged to hold the gasket in the groove, the projections cooperating with a holding part.

Such a gasket arrangement is described in the Swedish Pat. No. 421.241 (corresponding U.S. Pat. No. 4,377,204). According to this known arrangement there has been made a hole in the heat exchanger plate right in front of each projection of the gasket. This known gasket arrangement due to the mentioned holes leads to an essential increase in prices regarding the tools for the plate production and has not come into practical use to any great extent.

Another known gasket arrangement is based on the fact that the gasket groove of the heat exchanger is made with a dovetail formed or a similar cross section, whereby a gasket having essentially the same cross section, after having been applied into the groove, can be held on the plate without special fastening means. This gasket arrangement requires still more expensive tools for the plate production than the first-mentioned, known gasket arrangement.

As a consequence of the drawbacks with the above described gasket arrangements these ones have only to a little extent replaced the conventional method, known since long, of fastening gaskets to heat exchanger plates, i.e. to glue the gaskets into the gasket grooves of the plates. This method, however, has a great deal of practical disadvantages as has been stated in the above mentioned Swedish patent.

The purpose of the present invention is to bring about a new gasket arrangement which is not connected with the drawbacks with the above mentioned gasket arrangements but which still makes the manufacture of gaskets possible in until now a usual way without essential increase in price of necessary equipment for the manufacture.

This purpose is achieved by means of a gasket arrangement of the common kind mentioned by way of introduction comprising a gasket with projections on its side directed to the edge of the heat exchanger plate, which gasket arrangement is characterized in that the holding part comprises at least one projection that is directed to the gasket and is positioned at a distance from the gasket projection seen in the longitudinal direction of the gasket, and besides that the gasket projection and the projection are made in that way that when the gasket is in place in the groove on the one side of the heat exchanger plate, the gasket projection is on the same side but the projection is on the opposite side of the heat exchanger plate.

Figure 1:
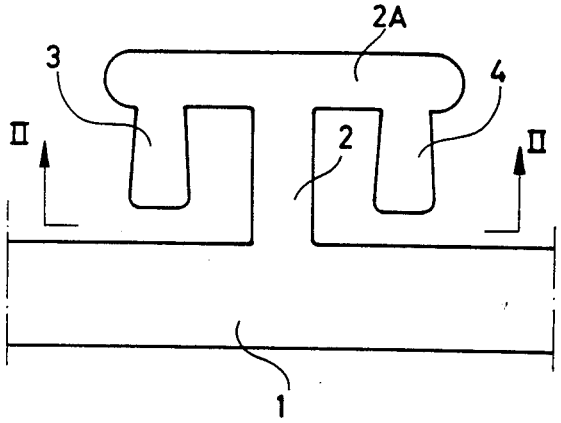
Figure 2:
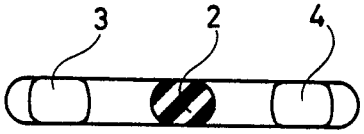
Figure 3:
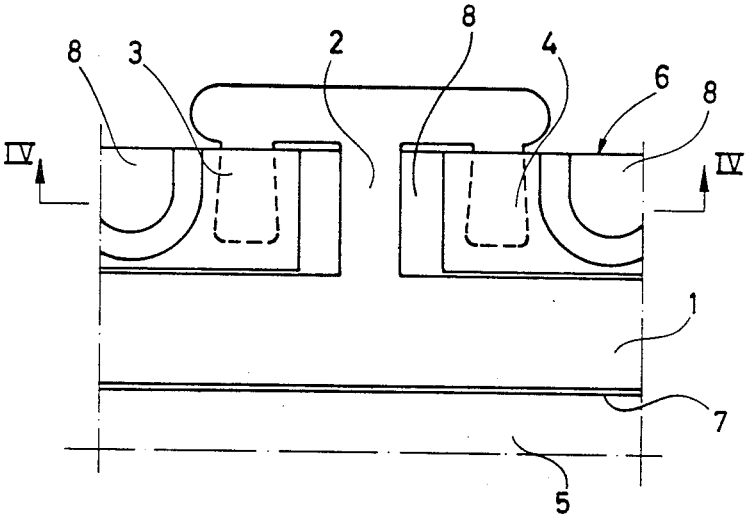
Figure 4:
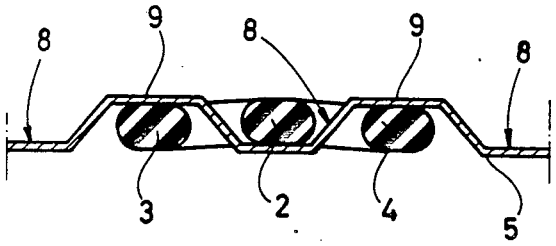
Figure 5:
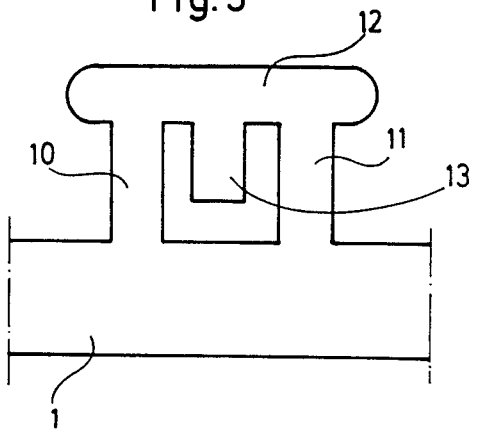
Figure 6:
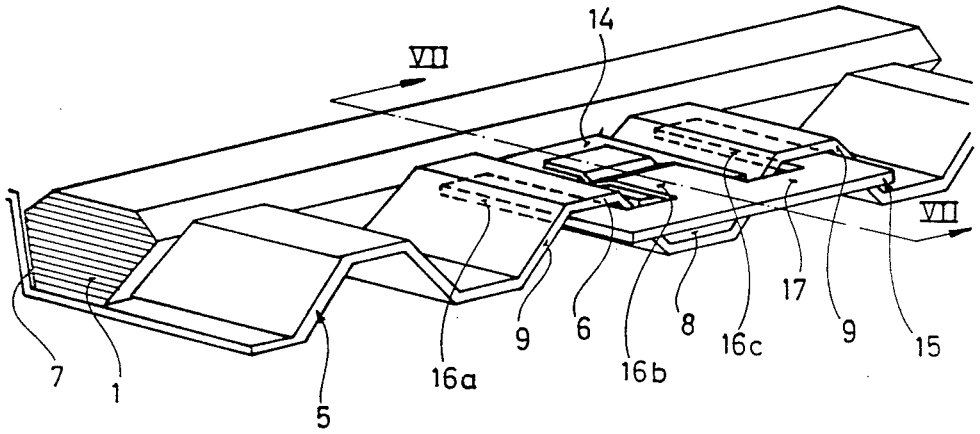
Figure 7:
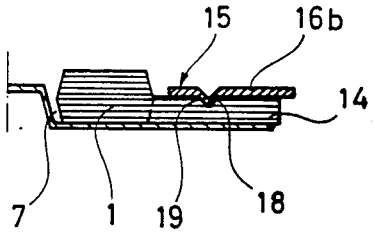
Figure 8:
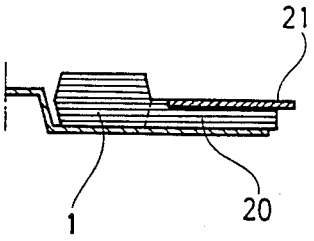

The invention shall be more closely described in the following with reference to the accompanying drawings, in which FIG. 1 shows a part of a gasket intended to be included in a gasket arrangement according to the invention, FIG. 2 shows a cross section view along the line II—II of FIG. 1, FIG. 3 shows a part of a heat exchanger plate with a gasket according to FIG. 1 applied into a gasket groove, FIG. 4 shows a cross section along the line IV—IV of FIG. 3, FIG. 5 shows a part of a gasket according to a modified embodiment, FIG. 6 shows a part of a heat exchanger plate with a gasket provided with a holding part according to another embodiment, FIG. 7 shows a cross section along the line VII—VII of FIG. 6, and FIG. 8 shows a similar cross section as in FIG. 7 but taken from a slight modified embodiment.

In FIG. 1 a part of a gasket 1 is disclosed that has a projection 2 made in one piece with the gasket so as to form an integral element. There are similar projections on several places along the gasket (not shown).

At a distance from the gasket 1 itself the gasket projection 2 carries two other projections 3 and 4, the free ends of which are directed towards the gasket 1. The projections 3 and 4 are connected with the gasket projection 2 by a bridge 2A and are positioned on each side of the gasket projection 2 in essentially the same plane as this one and the gasket.

It is advantageous from a handling point of view if the gasket and all projections are made with the same centre plane so that the gasket is turnable in the gasket groove of the plate.

In FIG. 3 there is shown a portion of an edge part of a heat exchanger plate 5 consisting of a relatively thin plate. The edge itself is marked with 6. Parallel with the edge 6 there is made a groove 7 in the plate, into which a gasket 1 according to FIG. 1 is applied.

The edge part of the plate is corrugated which is apparent from FIG. 4 so that valleys 8 and ridges 9 extend parallel and transversely to the gasket groove 7 on the same side of the plate as that one. Corresponding valleys and ridges are formed on the other side of the plate. Thus, a corrugating valley on one side of the plate corresponds to a corrugating ridge on the other side of the plate and vice versa.

Of the three corrugating valleys 8 disclosed in FIG. 3 the two outer ones extend from the edge 6 of the plate to a point positioned a little way from the gasket groove 7, while the middle corrugating valley 8 extends from the edge of the plate right to the gasket groove. Thus, the bottom of the gasket groove according to this embodiment of the invention is positioned in the same plane as the bottom of this middle corrugating valley.

The gasket 1 is held in the gasket groove 7 in that way that the gasket projection 2 extends out of the edge 6 of the plate in the mentioned middle corrugating valley 8 on the same side of the heat exchanger plate as the gasket groove, while both projections 3 and 4 extend from the plate edge 6 back towards the gasket groove in corrugating valleys on the opposite side of the heat exchanger plate. Thus the bridge 2A and the projections 3, 4 constitute a holding part for the gasket projection 2 in the corrugating valley 8.

In the drawing there is only shown a part of a straight gasket 1 placed into a straight gasket groove 7. Such straight gasket grooves made along an edge of a plate normally constitute a part of a gasket groove surrounding the heat exchanging area itself of a heat exchanger plate. The present invention, however, is also applicable in connection with a gasket groove usually having a circular extension, which groove surrounds a hole in the heat exchanger plate positioned outside its real heat exchanging area. Such holes are made in heat exchanger plates in order to make a passage for one of the two heat exchanging media possible, which are flowing through a plate heat exchanger, passing plate interspaces intended for the second heat exchanging medium.

In FIG. 5 there is shown a modification of the embodiment shown in FIGS. 1–4. Thus, the figure discloses a part of a gasket 1 which is provided with projections 10, 11 made in one piece with the gasket. The ends of the projections 10, 11 are connected with each other by a bridge 12 which extends parallel with the gasket 1. Between the gasket projections 10, 11 and in one piece with the bridge 12 there is made a projection 13, the free end of which is directed to the gasket 1. The bridge 12 and the projection 13 constitute a holding part for the gasket projections 10, 11.

When applying the gasket 1 in a heat exchanger plate the gasket projections 10, 11 are placed in each corrugating valley in the edge part of the plate on the one side of the plate so that the bridge 12 is positioned just outside the plate edge. The gasket 1 is held in the gasket groove in that way that the projection 13 extends from the plate edge 6 back towards the gasket groove in a corrugating valley on the opposite side of the heat exchanger plate.

In FIGS. 6 and 7 there is shown a further embodiment of the invention. The gasket 1 is in FIG. 6 put into a groove 7 of a heat exchanger plate 5. In this connection the gasket as in the previously described embodiments is provided with projections 14 which are placed in corrugating valleys 8. The gasket 1 is held in the gasket groove 7 by a special holding part 15. This part 15 comprises three projections 16*a, b, c* made in essentially the same plane and connected together by a bridge 17.

When applying the holding part 15 this one is pushed into the corrugations of the plate edge 6 in the direction of the gasket 1. In this connection the middle projection 16*b* of the holding part 15 is applied on the upper side of the gasket projection 14, while the two outer projections 16*a, c* of the holding part 15 are pushed into corrugating valleys on the opposite side of the plate as is shown in FIG. 6. Due to that fact the middle projection 16*b* of the holding part 15 is forcing the gasket projection 14 down into the corrugating valley 8. In order to secure a good holding of the gasket projection 14 in the corrugating valley 8 the middle projection 16*b* of the holding part 15 is provided with a protuberance 18 which cooperates with a corresponding recess 19 on the upper side of the gasket projection 14 (see FIG. 7).

In FIG. 8 there is shown a modification of the gasket arrangement according to FIGS. 6 and 7. The gasket 1 is provided with a projection 20 that cooperates with a holding part 21, which in similarity with the holding part 15 according to FIGS. 6, 7 comprises a bridge and three projections. In order to secure a good holding of the gasket projection 20 in the corrugating valley 8 and accordingly the gasket 1 in the groove 7 the middle projection of the holding part 21 is fastened to the gasket projection 20, preferably by vulcanization.

It is, of course, possible to modify the gasket arrangement according to the FIGS. 6–8 so that the outer projections of the holding part act on the gasket projections on the one side of the heat exchanger plate, while its middle projection is pushed into the corrugating valley on the opposite side of the plate. Moreover, the number of projections of the holding part can be modified.

What is claimed is:

1. In the combination of a heat exchange plate having a groove formed on one side thereof and extending along an adjacent edge of the plate, a sealing gasket inserted into the groove, and securing means spaced apart longitudinally of the gasket for holding the gasket in the groove, each said securing means including an integral element made in one piece with the gasket and projecting transversely of said gasket from that side of the gasket which faces said plate edge, said element extending to substantially said plate edge, each securing means also including attached thereto a holding part cooperating with said integral element and having at least one projection lying on the other side of the plate remote from said integral element, the improvement wherein said one projection is directed toward the gasket and is spaced from said integral element in the longitudinal direction of the gasket, said holding part extending around said plate edge and having its said projection engaging said other side of the plate while extending toward the gasket from said plate edge, said integral element lying on said one side of the plate.

2. The improvement of claim 1, in which said holding part is an integral part of the gasket and includes a bridge connecting said one projection with said integral element.

3. The improvement of claim 2, in which said holding part includes two projections between which said intregral element is located.

4. The improvement of claim 2, in which said gasket, integral element and projection have the same center plane so that the gasket is turnable in the groove.

5. The improvement of claim 1, in which said holding part is separate from the gasket and includes three projections lying in substantially the same plane, and a bridge interconnecting said projections.

6. The improvement of claim 5, in which said three projections include a middle one holding said integral element on the plate, said middle projection having a protuberance entering a recess in the upper side of said integral element.

7. The improvement of claim 5, in which said middle projection is fastened to said integral element.

8. The improvement of any of claims 1 through 7, in which the edge portion of the plate is corrugated outside the groove to form valleys and ridges extending transversely of the groove, said integral element extending from the gasket to the plate edge in a said valley on the same side of the plate as the groove, said projection extending in a said valley on the opposite side of the plate.

* * * * *